US007918414B1

(12) United States Patent
Davis et al.

(10) Patent No.: US 7,918,414 B1
(45) Date of Patent: Apr. 5, 2011

(54) METHOD AND APPARATUS FOR MANAGING WIRE ROPE SLINGS

(76) Inventors: Edward W. Davis, Madisonville, LA (US); Thomas E. Leblanc, Maurice, LA (US); William H. Hidalgo, Paterson, LA (US)

( * ) Notice: Subject to any disclaimer, the term of this patent is extended or adjusted under 35 U.S.C. 154(b) by 918 days.

(21) Appl. No.: 11/710,737

(22) Filed: Feb. 23, 2007

(51) Int. Cl.
*B65H 75/00* (2006.01)

(52) U.S. Cl. ..... 242/588; 242/557; 242/597.7; 242/597.8; 242/129; 211/70

(58) Field of Classification Search ..... 242/387, 242/388, 398, 402, 403, 406, 557, 588, 597, 242/597.7, 597.8, 129; 211/13.1, 61, 70, 211/78, 115, 95, 131.1, 163; 248/346.06, 248/75; 206/303, 386, 388, 389, 408
See application file for complete search history.

(56) References Cited

U.S. PATENT DOCUMENTS 1,036,008 A * 8/1912 Roeder ..... 242/407.1
2,300,243 A * 10/1942 Zierden ..... 242/387
2,452,378 A 10/1948 Hudson
3,224,707 A 12/1965 Arnold
3,272,455 A 9/1966 Stemberg et al.
3,524,538 A 8/1970 Marlowe
3,729,092 A 4/1973 Marcell
4,020,779 A 5/1977 Kitt
4,066,224 A 1/1978 Hargreaves et al.
4,151,965 A 5/1979 Manabe
4,189,823 A 2/1980 Neyenhuys
4,572,370 A 2/1986 Cedenblad et al.
5,025,999 A 6/1991 Littrell
6,957,929 B1 * 10/2005 Rachel et al. ..... 405/158
7,080,864 B2 7/2006 Casteran

* cited by examiner

*Primary Examiner* — William E Dondero

(57) ABSTRACT

An apparatus for the storing and management of a plurality of wire rope slings is presented, such slings being those typically comprised of a length of wire rope having at least one end loop. The apparatus has a base frame upon which is rotatably mounted a sling storage bin. The storage bin has a plurality of arm members that extend from the storage bin for engaging and holding an end loop of a selected wire rope sling. Rotation of the storage bin causes the selected wire rope sling to be coiled around said projecting arms within the storage bin. The apparatus may be provided with pad eyes and forklift tine guides to facilitate its transportation.

17 Claims, 6 Drawing Sheets

METHOD AND APPARATUS FOR MANAGING WIRE ROPE SLINGS

FIELD OF INVENTION

This invention generally relates to the field of wire rope sling storage and management. More particularly, it provides an improved method and apparatus for managing and transporting wire rope slings used in the shipping and oil and gas industries for hoisting, lifting, and transporting goods and materials.

BACKGROUND OF INVENTION

A typical metal wire rope lifting sling is comprised of a length of wire rope having a loop at each end formed by inserting or fitting the rope ends into a sleeve which is then swaged to bind the rope ends into a loop. These wire rope slings are commonly utilized as rigging for lifting and securing heavy loads. In the oil and gas industry, such slings are typically utilized for transporting, hoisting, and lifting shipping containers, pipe, materials, and equipment that are used in the drilling and production of oil and gas to and from well locations.

In the oil and gas industry wire rope slings are typically leased or rented for a particular job and returned to their supplier for inspection and certification before they are reused. Because the slings are used in the lifting of heavy loads, care must be taken to monitor any damage of the slings whether caused by their use or by shipping or storing the slings before and after their use. The wire rope slings used in the oil and gas industry are heavy and cumbersome and difficult to manage, store and transport because of their length, weight, and flexible nature. Storage and transportation of groups of slings can present a particular problem due to the space limitations typically associated with oil and gas drilling and production platforms.

There is an ongoing need for improved equipment for and methods to manage, store and transport wire rope slings to and from a well location to alleviate the time and expenses associated with such functions. The present invention provides an effective and efficient apparatus and method for conveniently managing, storing, and transporting wire rope slings will substantially reduce the inconvenience, time, and expense now currently associated with such efforts.

SUMMARY OF INVENTION

The present invention provides an improved method and apparatus for managing, storing, and transporting wire rope slings comprised of a length of wire rope having a loop at each end. It is contemplated that the method and apparatus described herein will reduce the risks and disadvantages currently associated with managing, storing, and transporting such wire rope slings.

The apparatus and method of the present invention provides a storage spool for the wire rope slings that utilizes a rotating sling storage plate. The rotating storage plate may be mounted on a transportable frame. The sling storage plate may have upwardly extending sidewalls to form a bin for holding the stored slings in place on the sling spool.

The apparatus is provided with a means for holding a wire rope sling. The sling storage plate has at least one and preferably two pair of substantially vertically projecting posts or sling retainers for holding the loops of a typical wire rope sling. The sling storage plate may be placed on casters or rollers and it may have a centrally positioned bearing assembly to provide for ease in its spinning or rotating.

Each projecting retainer in each pair is positioned on the sling storage plate at a location opposite from the other projecting retainer in each pair. The projecting sling retainers are positioned and configured to slidably receive and hold an end loop of a typical wire rope sling.

Wire rope slings are loaded on the sling spool for storage, one sling at a time, by placing the end loops of each sling over a selected sling retainer to retain the end lop on the sling retainer. To start the loading process, one of the end loops of the first sling is placed over one of the extending sling retainers. Then the sling spool is rotated as a worker walks or wraps the length of wire rope on the sling around the extending sling retainers onto the sling storage plate.

Subsequent slings are added to the storage spool in a like manner. It is preferable but not required that each subsequent sling be placed on the storage spool so that the first end loop of each subsequent sling is placed over the sling retainer on the opposite side from the sling retainer where the first loop of the previous sling was started. The process is repeated until the desired number of slings is placed on the sling spool. Slings of different lengths can be stored on the sling on the sling spool in this manner.

Slings are removed from the sling spool one at a time in a manner opposite to that utilized in placing the slings on the sling spool. A loop from the top sling on the sling spool is removed from its corresponding retainer and pulled to spin the spool to unwind and remove the stored sling from the spool.

Typically at least two workers are utilized to place and remove slings from the sling spool, one to spin the sling spool and one to handle the sling. The workers may rotate the jobs as slings are added or removed from the sling spool.

The rotating sling storage plate or bin may be placed on a base plate or frame. The frame may have pad eyes for placement of slings to facilitate lifting the sling spool for transportation. The frame may also have a guide system or pathway such as spaces between framing members for receiving the tines of a forklift to further facilitate lifting the sling spool for transportation. The sling spool as contemplated and described is simple to operate and should have a compact design and "footprint" to minimize the space required for transporting and storing the sling spool as such space is limited on many work boats and drilling rigs.

The rotating sling spool allows the slings to be conveniently coiled around the sling retainers and stacked for stored on the rotating storage plate. This apparatus and method provides a convenient method to coil the slings, keeps them organized, readily transportable, and eliminates clutter on a drilling platform.

DESCRIPTION OF PREFERRED EMBODIMENT

Figure 1:
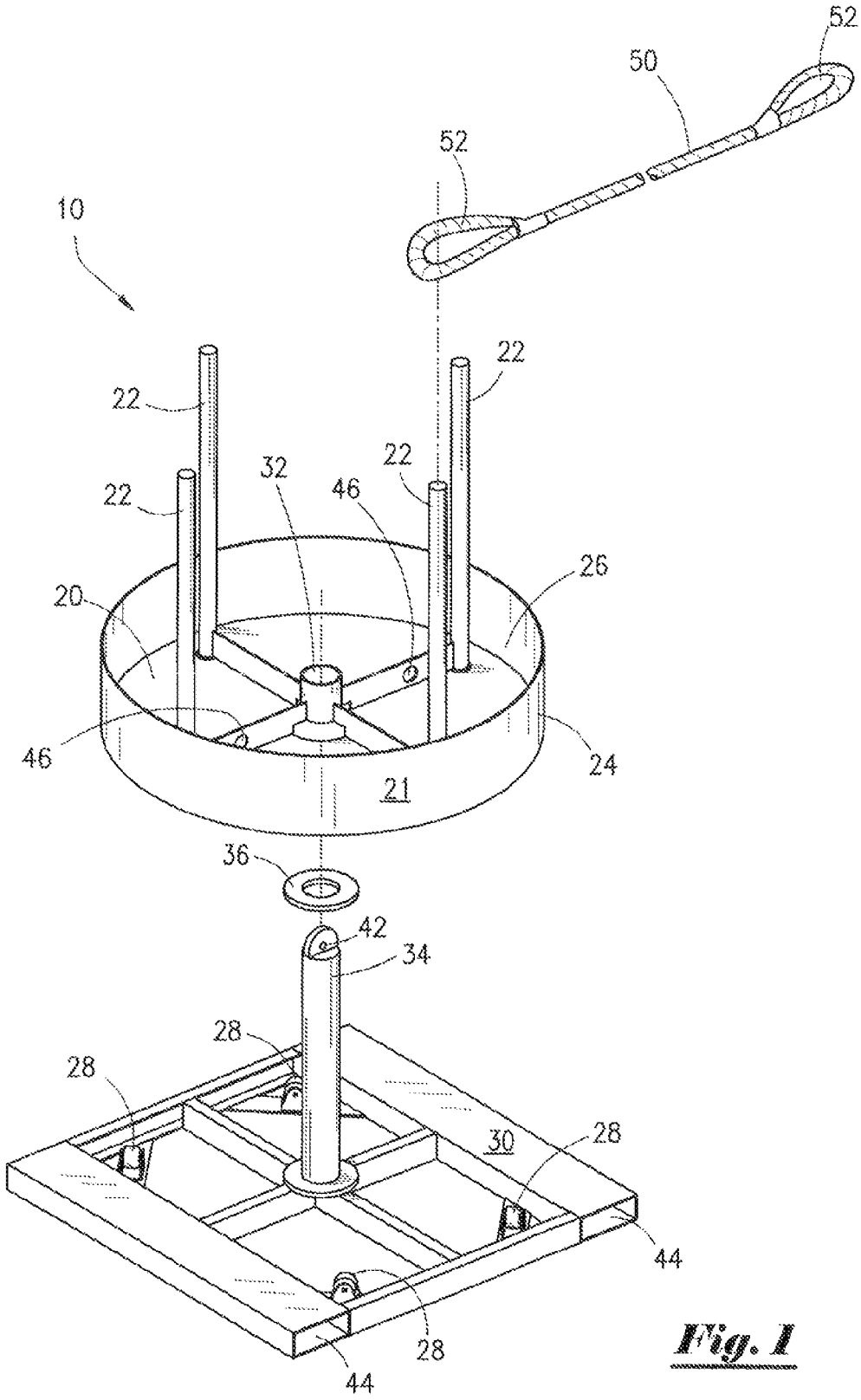
FIG. 1 is an exploded perspective view of an embodiment of the sling spool system of Applicants' invention.

Referring now to the drawings and more particularly to FIG. 1, there is shown an exploded perspective view of sling spool apparatus (10) for managing, storing, and transporting conventional wire rope slings (50). It is contemplated that the wire rope slings (50) would be those comprised of a length of wire rope having a loop (52) at each end as shown though other sling configurations such as those with a loop (52) only at one end of the sling (50) or those with a clevis or hooked end at the ends of the sling (50) rather than a loop might also be utilized with the apparatus (10).

Figure 2:
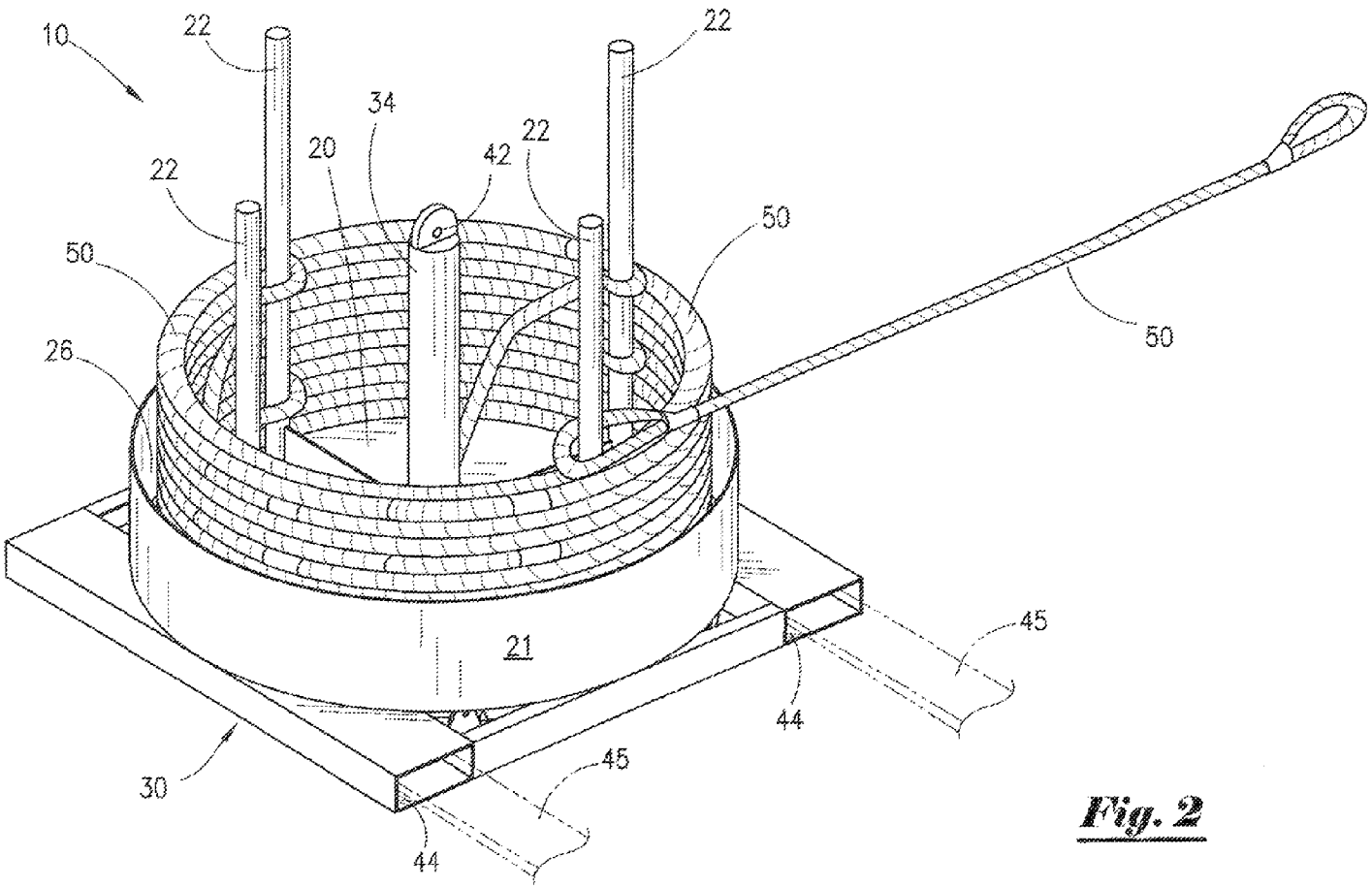
FIG. 2 is a perspective view of the embodiment of the sling spool bin depicted in FIG. 1 with slings in place.
Figure 3:
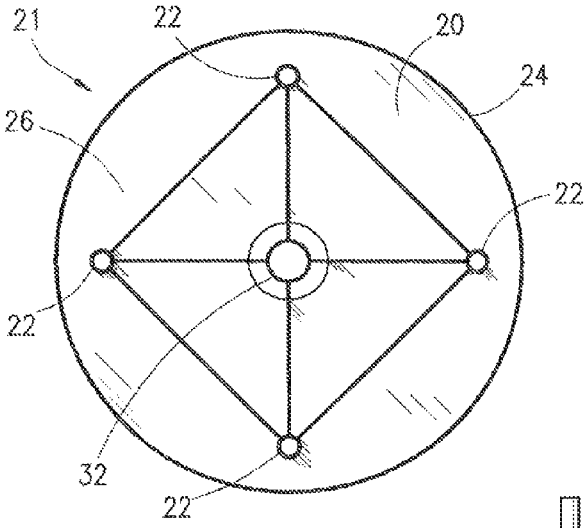
FIG. 3 is a plan view of the embodiment of the sling spool base depicted in FIG. 1.
Figure 4:
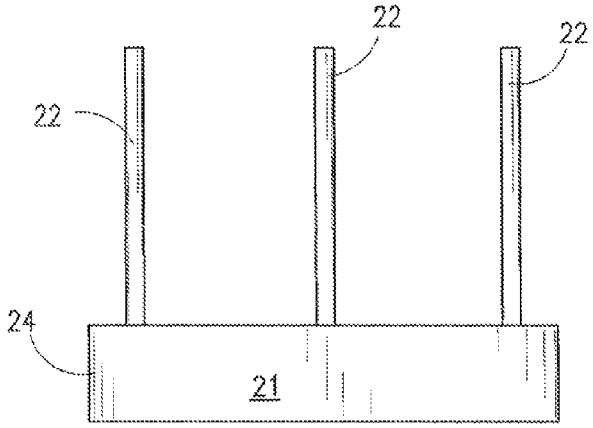
FIG. 4 is an elevation view of the embodiment of the sling spool bin depicted in FIG. 1.
Figure 7:
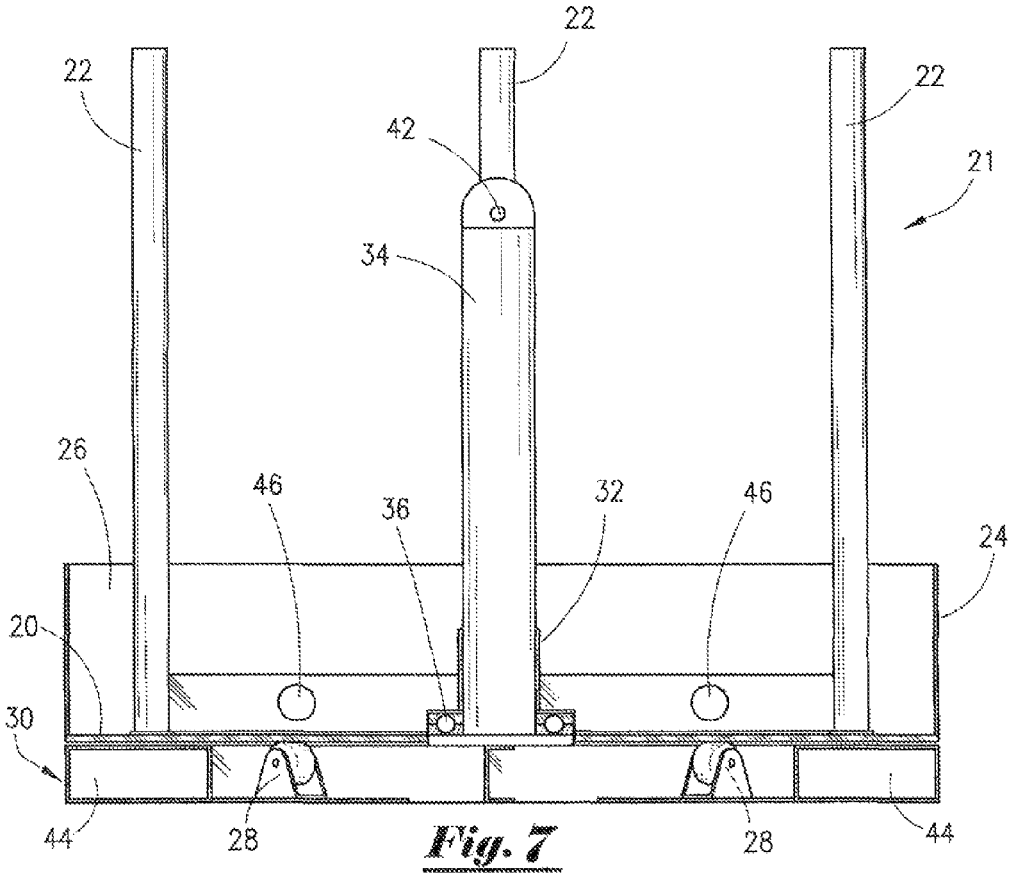
FIG. 7 is a cross-section view of the base and bin combination of the sling spool system depicted in FIG. 1.

In the embodiment shown in FIG. 1, again in FIG. 2, and in cross-section in FIG. 7, a substantially horizontally orientated sling storage plate (20) is rotatably mounted upon a substantially horizontally orientated base frame (30) to form a bin assembly (21). As can be seen in FIG. 2, FIG. 3, and FIG. 4, the sling storage plate (20) has at least one and preferably two pair of substantially vertically projecting posts or sling retainers (22). Each projecting sling retainer (22) in each pair of retainers (22) is preferably positioned on the sling storage plate (20) at a location substantially opposite from the other projecting retainer (22) in each pair.

The projecting sling retainers (22) are positioned and configured to slidably receive and hold the end loops of a typical wire rope sling (50). The sling storage plate (20) may have upwardly extending sidewalls (24) extending around the periphery of the sling storage plate (20) to form a bin area (26) for retaining the stored slings (50).

Figure 5:
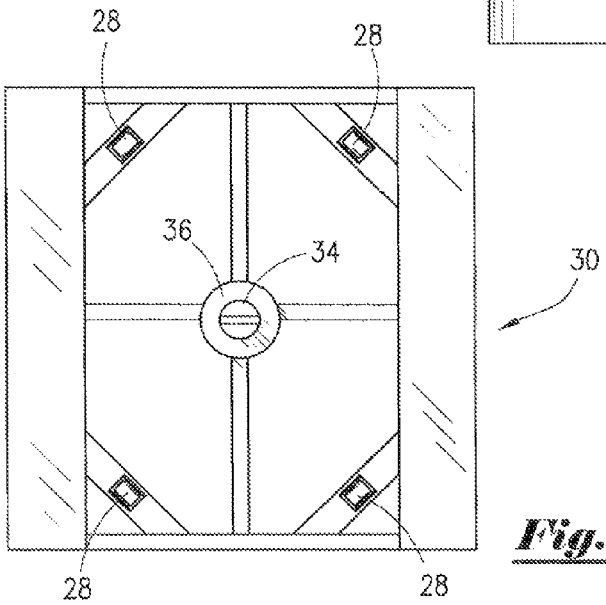
FIG. 5 is a plan view of the embodiment of the sling spool base depicted in FIG. 1.

The sling storage plate (20) may also have a substantially centrally orientated bushing (32) for receiving a vertically extending axle post (34) mounted substantially centrally on the base frame (30) about which sling storage plate rotates. A bearing assembly (36), such a ball thrust bearing, is positioned between the based frame (30) and the sling storage plate (20) to facilitate such rotation. The sling storage plate (20) is may also be further supported on the base frame (30) by a plurality of casters or rollers (28), shown in FIG. 1, FIG. 5, and FIG. 7 to further provide means for facilitating the spinning or rotating of the sling storage plate (20) about the axle post (34) on the base frame (30). The sling storage plate may also be provided with lifting eyes (46) for inserting a hook or clevis to provide means for lifting the sling storage plate for its placement onto or off of the base frame (30).

Figure 6:
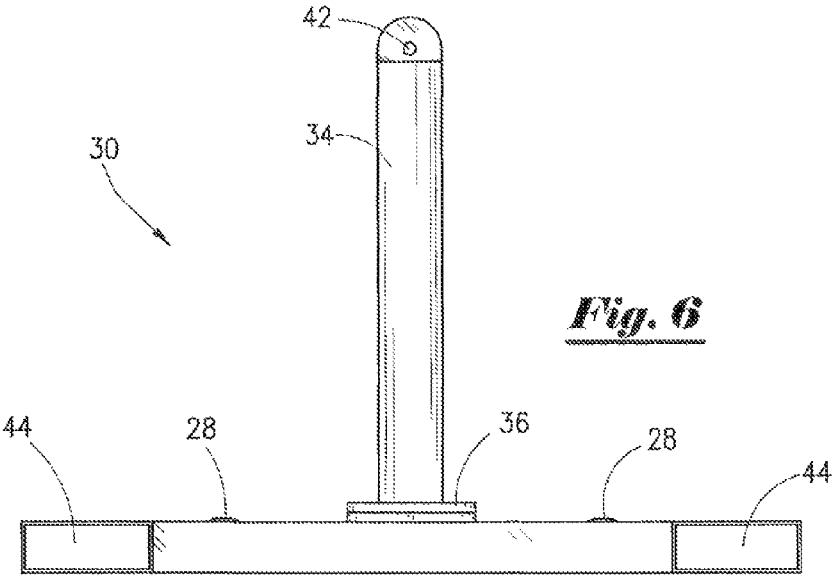
FIG. 6 is an elevation view of the embodiment of the sling spool base depicted in FIG. 1.

As shown in FIG. 6, an elevation view of the base frame (30), pad eyes may be mounted to the base frame, here depicted as a single pad eye (42) mounted to on the end of the axle post (34), to allow for the ready lifting of the sling spool (10) for transportation. It is thought that pad eyes (42) could be mounted on the base frame (30) at other convenient locations to facilitate the ready transportation of the sling spool. As shown in FIG. 2, the base frame (30) may also be provided with slotted openings or spaces (44) for receiving forklift tines (45) of a forklift to afford additional means for lifting the sling spool (10) for transportation.

Wire rope slings (50) such as those depicted in FIG. 1 and in FIG. 2 are loaded on the sling spool for storage, one sling at a time, by placing a selected end loop (52) of each sling (50) over a selected sling retainer (22). The sling (50) is then retained or held on the sling retainer by means of the end loop (52) and the retainer (22).

To start the loading process, one of the end loops (52) of a first sling (50) is placed over one of the extending sling retainers (22). Then the sling storage plate (20) is rotated as a worker "walks" or wraps the length of wire rope on the sling (50) around the other extending sling retainers (22). The remaining end of the first sling is then positioned on the storage plate (20) within the bin (26) to complete the storage of that sling (50). The next sling (50) to be stored is preferably then be started so that its first end loop (52) is placed over the sling retainer (22) on the opposite side from the sling retainer (22) where the first loop of the previous sling was started with the above rotating process repeated for this second and any subsequent sling (50). The process is repeated until a desired quantity of slings (50) is placed on the sling spool (10).

Slings (50) are removed from the sling spool (10) one at a time in a manner opposite to that utilized in placing the slings on the sling spool. A loop from the top sling (50) on the sling spool (10) is removed from its corresponding retainer (22) and pulled to rotate the sling storage plate (20) to unwind the sling (50) from around the extending sling retainers (22) on the sling spool (10). The remaining loop of the sling (50) is then removed from its corresponding retainer (22) and the process is repeated until the desired numbers of slings (50) is removed.

Only two workers are typically utilized to place and remove slings (50) from the sling spool (10), one to spin the sling storage plate (20) and one to handle the sling (50). The workers may rotate the jobs as slings (50) are added or removed from the sling spool (10). However, the device may be utilized with only one worker if necessary.

Figure 8:
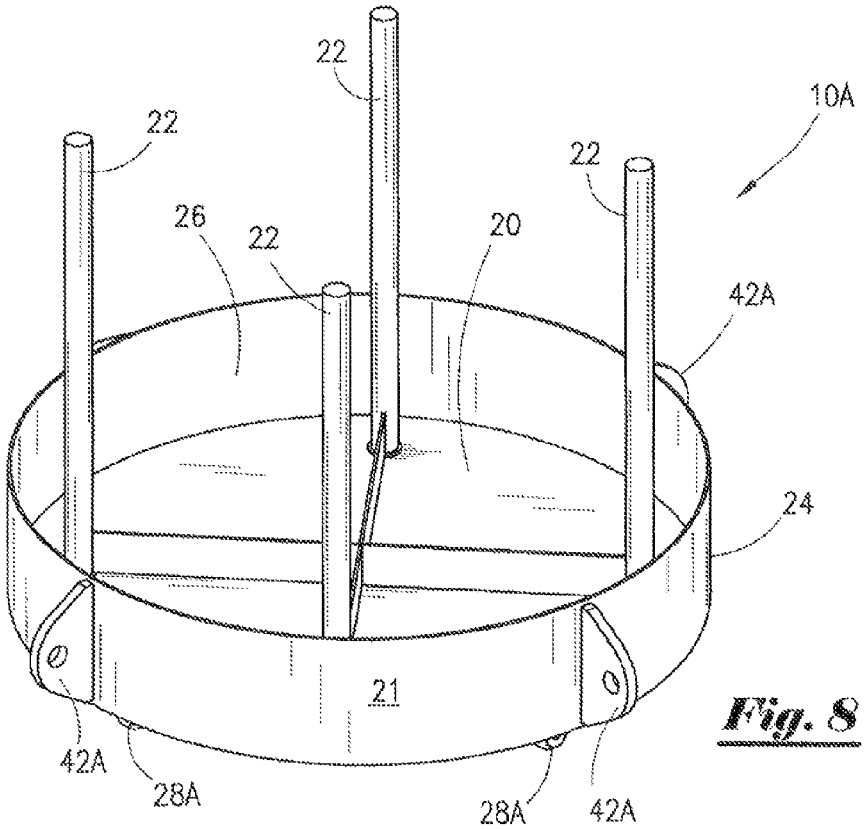
FIG. 8 is a perspective view of another embodiment of a sling spool system of Applicants' invention.
Figure 9:
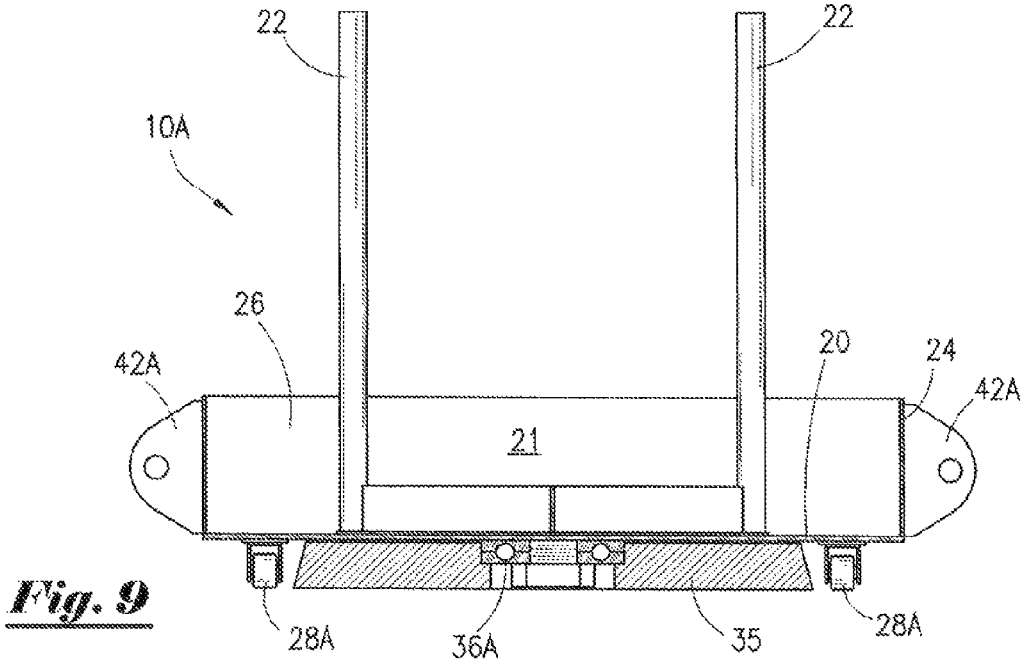
FIG. 9 is a cross-section view of the sling spool system depicted in FIG. 8.

FIG. 8 and FIG. 9 depict an alternate embodiment of the sling spool apparatus of Applicants' invention. In this alternative embodiment, the sling spool apparatus (10A) as shown also has a substantially horizontally orientated rotatable sling storage plate (20) forming bin assembly (21). As illustrated, the sling storage plate (20) has at least one and preferably two pair of substantially vertically projecting posts or sling retainers (22). Each projecting sling retainer (22) in each pair of retainers (22) is positioned on the sling storage plate (20) at a location opposite from the other projecting retainer (22) in each pair.

The projecting sling retainers (22) are positioned and configured to slidably receive and hold the end loops (52) of a typical wire rope sling (50). The sling storage plate (20) may also have upwardly extending sidewalls (24) extending around the periphery of the sling storage plate (20) to form a bin area (26) for retaining the stored slings (50).

A bearing assembly (36A), such a ball thrust bearing, is positioned below the sling storage plate (20) between a substantially horizontal and stationary bearing floor plate (35) to facilitate rotation of the sling storage plate (20) and the accompanying sling retainers (22) about the bearing plate (35). The sling storage plate (20) and bin (26) may also be further supported in its rotation by a plurality of casters or rollers (28A) to further provide means for facilitating the spinning or rotating of the sling storage plate (20) about the bearing floor plate (35). A plurality of pad eyes (42A) may be mounted on the walls (22) of storage bin (26) to facilitate the transportation of the sling spool (10A). Slings (50) are added to and removed from the sling spool apparatus (10A) in the same manner as described above for sling spool apparatus (10).

Figure 10:
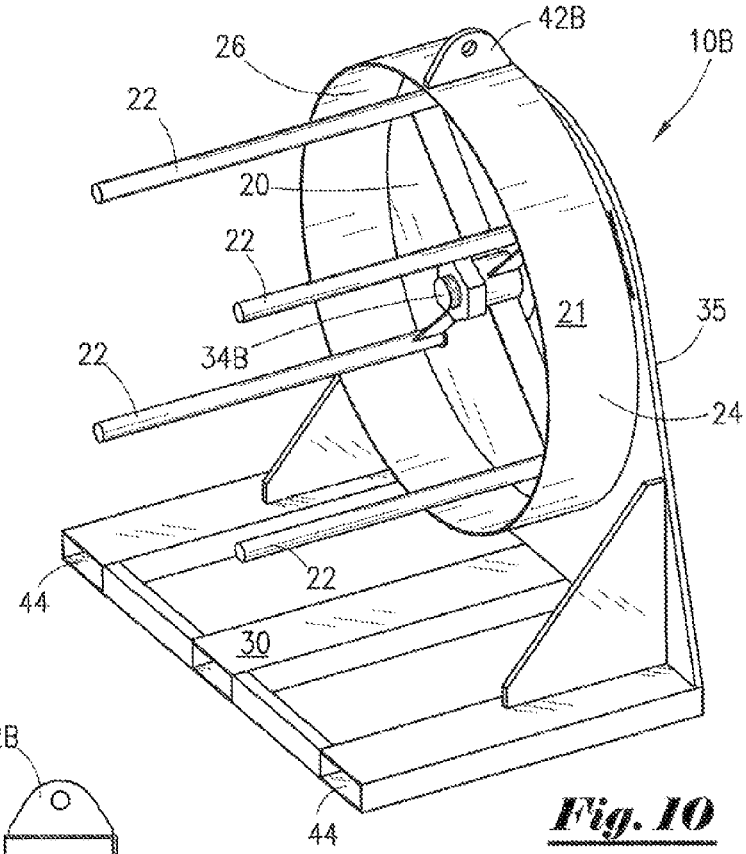
FIG. 10 is a perspective view of still another embodiment of a sling spool system of Applicants' invention.
Figure 11:
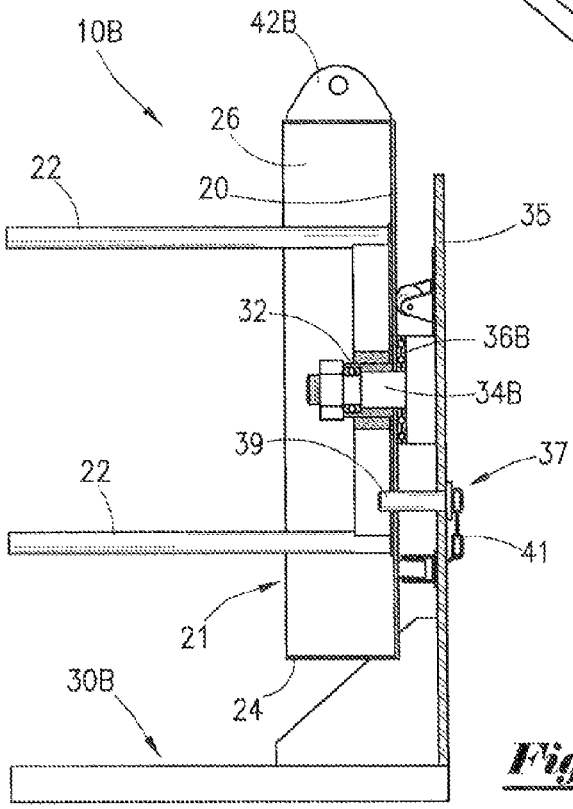
FIG. 11 is a cross-section view of the sling spool system depicted in FIG. 10.

FIG. 10 and FIG. 11 depict still another alternate embodiment of the sling spool apparatus of Applicants invention. In the alternative embodiment, the sling spool apparatus (10B) as shown also has a substantially vertically oriented rotatable sling storage plate (20) forming bin assembly (21). As illustrated, the sling storage plate (20) has at least one and preferably two pair of substantially horizontally projecting posts or sling retainers (22). Each projecting sling retainer (22) in each pair of retainers (22) is positioned on the sling storage plate (20) at a location opposite from the other projecting retainer (22) in each pair.

The projecting sling retainers (22) are positioned and configured to slidably receive and hold the end loops (52) of a typical wire rope sling (50). The sling storage plate (20) may also have upwardly extending sidewalls (24) extending around the periphery of the sling storage plate (20) to form a bin area (26) for retaining the stored slings (50).

A frame (30B) having a vertically orientated support bracket (35) is provided to support the storage plate (20). The storage plate (20) is mounted on the bracket (35) by means of a substantially centrally orientated bushing (32) position on the storage plate and a horizontally extending axle (34B) that extends from the bracket (35) about which the sling storage plate (20) rotates. A bearing assembly (34B) may be provided to facilitate rotation of the sling storage plate (20) and the accompanying sling retainers (22) about the extending axle (34B). Slings (50) are added to and removed from the sling spool apparatus (10B) in substantially the same manner as described above.

A pad eye (42B), or multiple pad eyes (42B), may be mounted on the sling spool apparatus (10B), such as shown bin wall (24) to facilitate the lifting and transportation of the sling spool (10B). A braking means (37) such as an arrangement of lugs (39) and chains (41) may also be provided to prevent the rotation of the sling storage plate (20) and bin (26) during transportation. The frame (30B) may also be provided with slotted openings or spaces (44) for receiving the tines of a forklift to afford additional means for lifting the sling spool (10B) for transportation.

It is thought that the wire rope sling spool management, storage, and transporting apparatus and methods described herein and many of their intended advantages will be understood from the foregoing description. It is also thought that various changes in form, construction, and arrangement of the parts of the proposed apparatus and methods may be made without departing from the spirit and scope of the inventions described herein.

What is claimed is:

1. An apparatus for the storing and management of a plurality of wire rope slings comprising (a) a horizontally oriented base frame;

(b) a horizontally orientated sling storage plate rotatably mounted upon said base frame;

(c) at least two substantially vertically projecting sling retainers, each said projecting sling retainers positioned substantially opposite from one another on said sling storage plate; and (d) a plurality of wire rope slings, each sling in said plurality of wire rope slings having at least one loop-end, each said loop-end configured to receive one of said vertically projecting sling retainers.

2. The apparatus for the storing and management of a plurality of wire rope slings as recited in claim 1 wherein, said rotatably mounted sling storage plate has sidewalls so as to form a bin area.

3. The apparatus for the storing and management of a plurality of wire rope slings as recited in claim 2 wherein, said apparatus includes at least one pad eye.

4. The apparatus for the storing and management of a plurality of wire rope slings as recited in claim 3 wherein, said base frame includes openings for forklift tines.

5. An apparatus for the storing and management of a plurality of wire rope slings comprised of a length of wire rope having with at least one end loop, comprising:

(a) a plurality of wire rope slings (b) a horizontally oriented base frame;

(c) a vertically extending axle post mounted on said base frame;

(d) a storage bin, said storage bin comprised of a horizontally oriented storage plate rotatably mounted of said axle post; and (e) a plurality of sling retainers extending upward from said storage plate, each said sling retainer configured for releasably retaining an end loop of a selected wire rope sling selected from said plurality of wire rope slings whereby rotating said storage plate on said axle post causes said selected wire rope sling to be coiled around said sling retainers onto said storage bin.

6. The apparatus for the storing and management of a plurality of wire rope slings as recited in claim 5 wherein, said storage bin has upwardly extending sidewalls.

7. The apparatus for the storing and management of a plurality of wire rope slings as recited in claim 6 wherein, said storage bin is partially supported by a plurality of casters.

8. The apparatus for the storing and management of a plurality of wire rope slings as recited in claim 7 wherein, said axle post includes at least one pad eye to facilitate lifting of said apparatus.

9. The apparatus for the storing and management of a plurality of wire rope slings as recited in claim 8 wherein, said base frame includes openings for the tines of a forklift.

10. The apparatus for the storing and management of a plurality of wire rope slings as recited in claim 9 wherein, said storage plate includes a bearing assembly to facilitate rotation of said storage plate on said base frame about said axle post.

11. An apparatus for the storing and management of a plurality of wire rope slings comprised of a length of wire rope having at least one end loop, comprising:

(a) a plurality of wire rope slings (b) a horizontally oriented base frame, said base frame having an upwardly extending axle post;

(c) a horizontally oriented storage plate rotatably mounted on said upwardly extending axle post on the top of said base frame;

(d) at least one roller positioned between said base frame and said storage plate; and (e) a plurality of projecting sling retainers projecting upward from said storage plate for engaging and holding an end loop of a selected wire rope sling whereby engagement of said end loop on said sling retainer and rotation of said storage plate about said axle post will cause said selected wire rope sling to be coiled around said projecting sling retainers.

12. The apparatus for the storing and management of a plurality of wire rope slings as recited in claim 11 further comprising a bearing for rotatably mounting said storage plate on said axle post.

13. The apparatus for the storing and management of a plurality of wire rope slings as recited in claim 12 wherein, said storage plate is partially supported on a plurality of casters.

14. The apparatus for the storing and management of a plurality of wire rope slings as recited in claim 13 wherein, said storage plate includes sidewalls.

15. A method for storing and managing a plurality of wire rope slings comprised of a length of wire rope having at least one end loop, comprising the steps of:

(a) providing a plurality of wire rope slings, each wire rope sling in said plurality of wire rope slings having a loop end;

(b) providing a storage apparatus, said storage apparatus comprising:

(i) a horizontally oriented base frame;

(ii) a vertically extending axle post mounted on said base frame;

(iii) a storage bin, said storage area comprised of a horizontally oriented storage plate rotatably mounted of said axle post, said storage plate partially supported on said base frame by a plurality of casters; and (iv) a plurality of sling retainers extending upward from said horizontally oriented storage plate, each said sling post configured for releasably receiving and retaining said end loop of a selected wire rope sling selected from said plurality of wire rope slings;

(c) selecting a wire rope sling from said plurality of wire rope slings and placing said end loop of each of said selected wire rope sling onto a selected sling retainer and thereby retaining said end loop on said sling retainer;

(d) rotating said storage plate and thus said storage bin about said axle post in a desired direction whereby said selected wire rope sling is coiled around said plurality sling retainers onto said storage bin;

(e) selecting subsequent wire rope slings from said plurality of wire rope slings and placing said end loop of each said subsequent selected wire rope sling onto a selected sling retainer and thereby retaining said end loop on said sling retainer and rotating said storage plate and thus said storage bin about said axle post in a desired direction whereby each said subsequent selected wire rope sling is coiled in turn around said plurality sling retainers and onto said storage bin;

(f) providing means for transporting said storage apparatus; and (g) transporting said storage apparatus with said stored slings to a desired location.

16. The method as recited in claim 15, further comprising the steps of:

(a) rotating said storage plate and thus said storage bin about said axle post in a desired direction whereby a said selected wire rope sling is uncoiled from around said sling retainers; and (b) removing said end loop of said selected wire rope sling from said sling retainer.

17. The method as recited in claim 15, wherein said storage bin of said storage apparatus has sidewalls.

* * * * *